US006605026B1

(12) United States Patent
Tomic

(10) Patent No.: US 6,605,026 B1
(45) Date of Patent: Aug. 12, 2003

(54) TAMPER-EVIDENT SLIDER PACKAGES WITH MULTIPLE TEAR POINTS

(75) Inventor: Mladomir Tomic, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/928,144

(22) Filed: Aug. 13, 2001

Related U.S. Application Data

(62) Division of application No. 09/591,959, filed on Jun. 12, 2000.

(51) Int. Cl.[7] ..... B31B 1/90

(52) U.S. Cl. ..... 493/394; 493/213; 493/214; 493/927; 493/930

(58) Field of Search ..... 493/186, 212, 493/213, 214, 927, 930, 394

(56) References Cited

U.S. PATENT DOCUMENTS 5,063,069 A * 11/1991 Van Erden et al. ..... 383/203
5,823,933 A * 10/1998 Yeager ..... 493/210
6,217,216 B1 * 4/2001 Taheri ..... 383/207
6,286,189 B1 * 9/2001 Provan et al. ..... 24/30.5 R
6,286,999 B1 * 9/2001 Cappel et al. ..... 24/400
6,327,754 B1 * 12/2001 Belmont et al. ..... 24/389
6,376,035 B1 * 4/2002 Dobreski et al. ..... 383/64
6,427,421 B1 * 8/2002 Belmont et al. ..... 53/412

* cited by examiner

*Primary Examiner*—Eugene Kim
*Assistant Examiner*—Christopher Harmon
(74) *Attorney, Agent, or Firm*—Charles H. Dougherty, Jr.; Tracey D. Beiriger

(57) ABSTRACT

A reclosable zipper including a first closure profile, a second closure profile constructed and arranged to selectively mate with the first closure profile, and a web arrangement joining the first closure profile and the second closure profile. The web arrangement includes a plurality of tear regions radially spaced across the web arrangement. Each of the tear regions has a lower shear strength than the remaining portions of the web arrangement. The tear regions may include multiple layers and have geometric shapes, such as a T, a trapezoid, a triangle, a round, and a rectangle. In some embodiments, there is a second web arrangement joining the first and second closure profiles. This reclosable zipper can be used on a flexible package to create a tamper-evident flexible package. Methods of operation are described.

11 Claims, 8 Drawing Sheets

TAMPER-EVIDENT SLIDER PACKAGES WITH MULTIPLE TEAR POINTS

CROSS REFERENCE TO RELATED APPLICATIONS

This application is a division of application Ser. No. 09/591,959, filed Jun. 12, 2000.

FIELD OF THE DISCLOSURE

This disclosure generally relates to closure arrangements for polymer packages, such as plastic bags. In particular, this disclosure describes reclosable packages with tamper-evident structures.

BACKGROUND

Form, fill, and seal technology is known in the packaging industry as a method to package consumable goods. Consumable goods that are not used completely when the package is initially opened rely on a zipper closure to reclose the package and keep the remaining contents fresh. Examples of consumable goods that are often packaged in packages with a zipper closure include potting soil, fertilizer, pet food, dog biscuits, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure or seal, to notify whether access has been gained to the zipper closure, is desired. Improvements in these types of packages are desirable.

SUMMARY OF THE DISCLOSURE

The present disclosure relates to a reclosable zipper including a first closure profile, a second closure profile constructed and arranged to selectively mate with the first closure profile, and a web arrangement joining the first closure profile and the second closure profile. The web arrangement includes a plurality of tear regions radially spaced across the web arrangement. Each of the tear regions has a lower shear strength than the remaining portions of the web arrangement.

The reclosable zipper can be used on a flexible package to create a tamper-evident flexible package. The flexible package includes a package surrounding wall defining an interior and having a mouth. A reclosable zipper is provided along the mouth for selective opening and closing of the mouth. The reclosable zipper is mounted on the package. The reclosable zipper includes a web arrangement with a plurality of tear regions radially spaced along the web arrangement. Each tear region has a lower shear strength than the remaining portion of the web arrangement.

Methods of operation are described. Methods include a step of providing a package with a reclosable zipper. The reclosable zipper includes a web arrangement with a plurality of tear regions radially spaced along the web arrangement. Each tear region has a lower shear strength than the remaining portion of the web arrangement. The method further includes a step of penetrating the web arrangement through at least one tear region.

DETAILED DESCRIPTION

Flexible Reclosable Package

Figure 1:
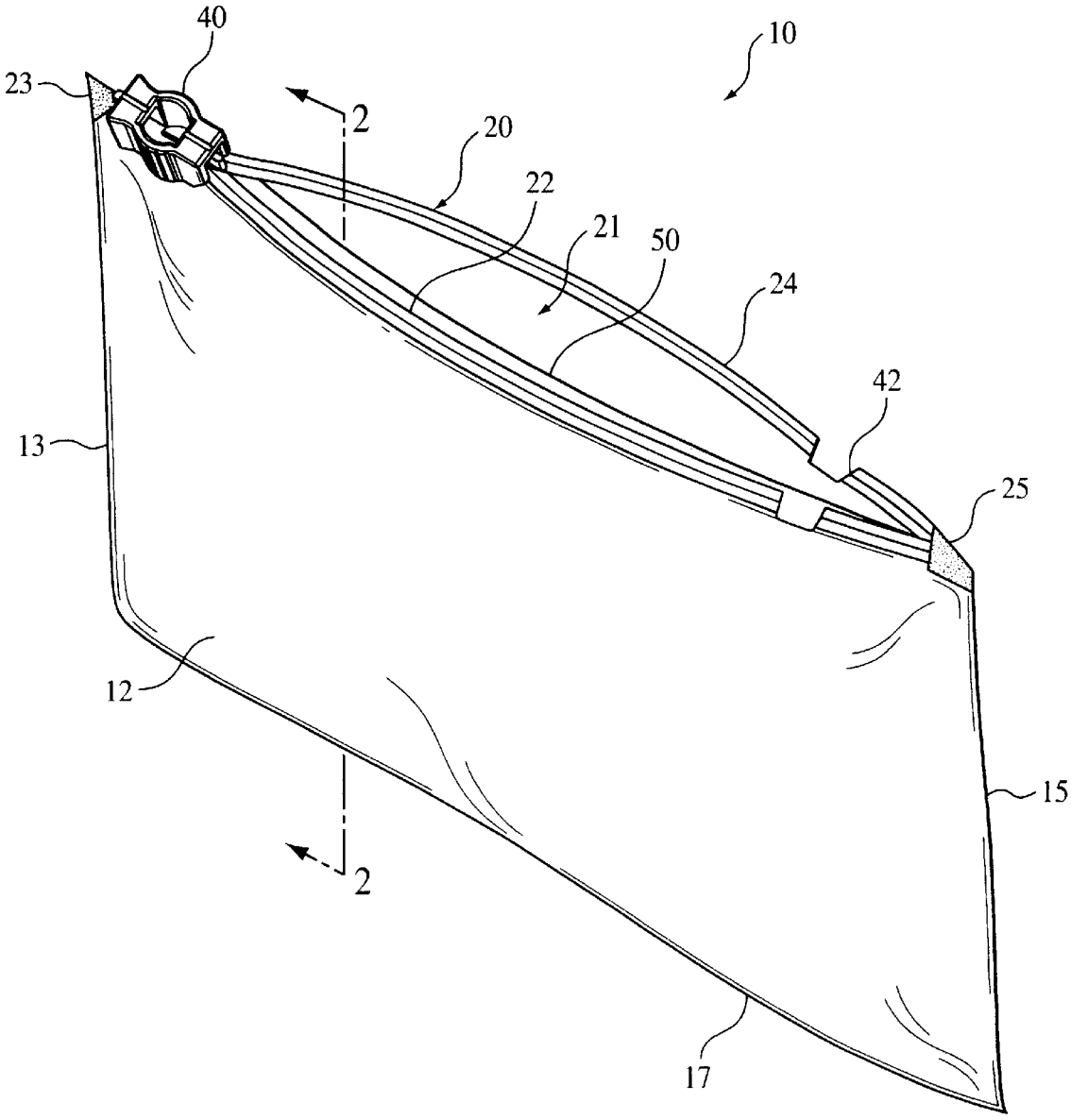
FIG. 1 is a perspective view of a flexible, reclosable package.
Figure 2:
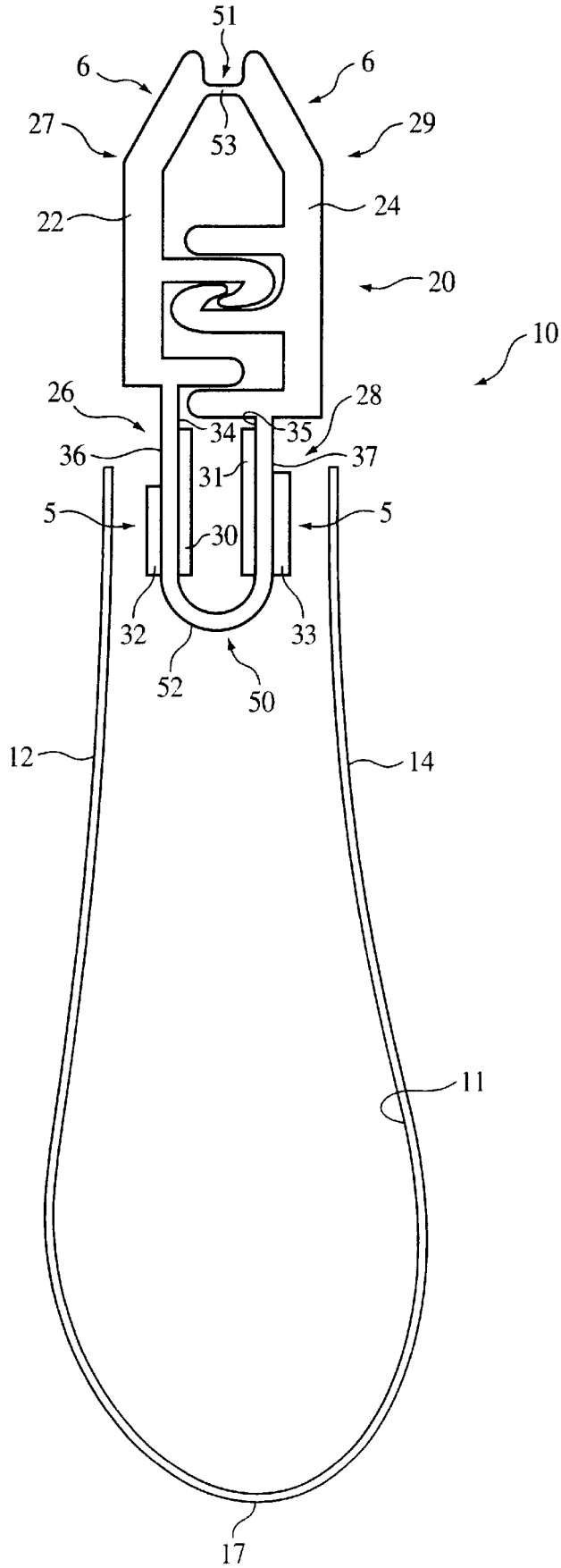
FIG. 2 is a schematic, cross-sectional view of a flexible, reclosable package similar to that depicted in FIG. 1, taken along line 2—2 of FIG. 1.

A flexible, reclosable package 10 is shown in FIGS. 1 and 2. Package 10 has opposing side panels 12 and 14 defining an interior 11; side panels 12, 14 are generally polymeric film. Package 10 includes opposite side edges 13, 15 and bottom edge 17. The distance between first side edge 13 and second side edge 15 is the length of package 10. Preferably, each of first side edge 13 and second side edge 15 is a heat seal between side panels 12, 14, which is formed when a single sheet of film is folded to form the two side panels. Bottom edge 17 can be a fold line formed when a single piece of film is folded, or bottom edge 17 can be a seal, created by the application of heat and pressure to side panels 12, 14.

Throughout this disclosure, the side of the package having the bottom edge 17 will be referred to as the "bottom" of the package, and the side having the zipper closure 20 will be referred to as the "top" of the bag. It is understood that package 10 can be oriented so that bottom edge 17 is not positioned below zipper closure 20; nevertheless, the reference for "top" at the zipper closure remains.

A mouth 21 provides access to interior 11 of package 10 along the top of the package. A zipper closure 20 has mating or closure profiles 22, 24 to open and close (unseal and reseal) the mouth 21 of package 10. The zipper closure 20 extends across the length of package 10. The zipper closure 20 extends from first side edge 13 to second side edge 15. Preferably, in some arrangements, at each of first and second side edges 13, 15 is a crush point 23, 25. Crush points 23, 25 are areas where zipper closure 20 has been sealed to side panels 12, 14. The zipper closure 20 can include a variety of configurations and structures. Zipper closure 20 can be configured in any known manner, for example, such as disclosed in U.S. Pat. Nos. 4,240,241; 4,246,288; and 4,437,293; each of which is incorporated by reference herein.

Zipper Closure

Figure 3:
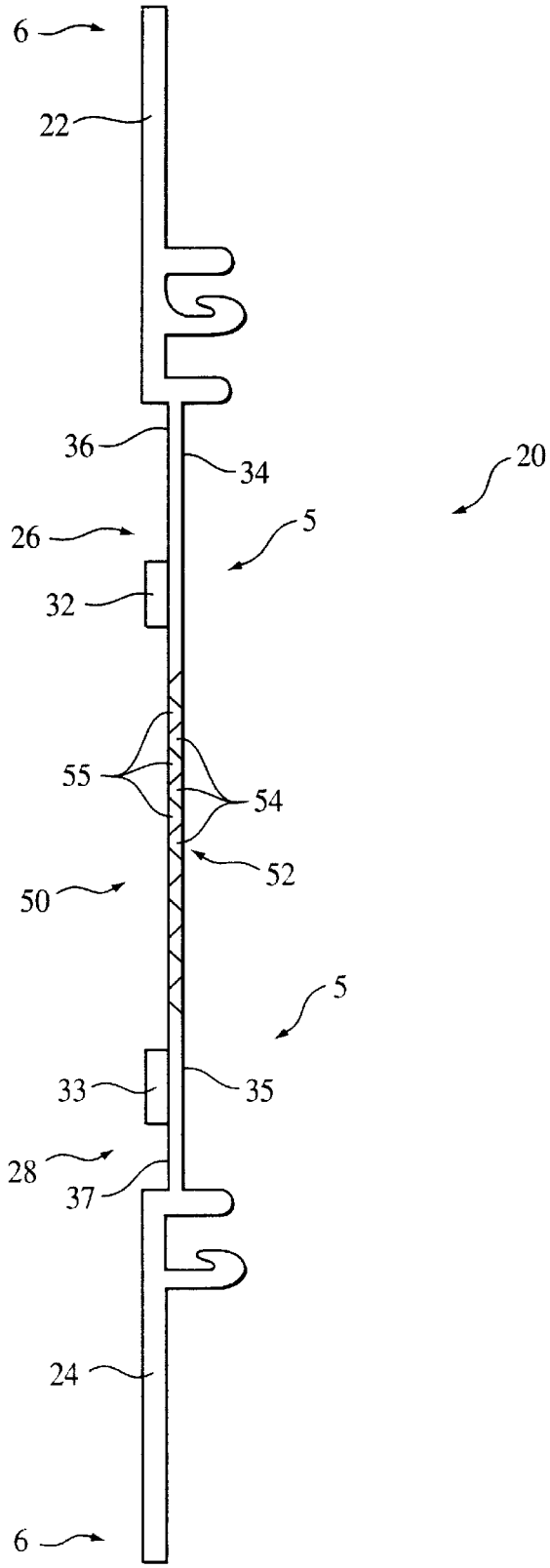
FIG. 3 is a cross-sectional view of the zipper closure prior to being incorporated into a package.

Zipper closure 20, FIG. 2 and FIG. 3, has a first closure profile 22 and a second closure profile 24 that engage and disengage, as appropriate, to open and close package 10. Zipper closure 20 generally extends from a first side edge 13 to a second side edge 15 at mouth 21 (FIG. 1). First and second closure profiles 22, 24 of zipper closure 20 are attached to side panels 12, 14, respectively, by sealing flanges 26, 28 as will be described in detail below. Sealing flanges 26, 28 are located at a first end 5 of the closure profiles 22, 24. Distal flanges 27, 29 are located at a second end 6 of the closure profiles 22, 24.

FIG. 3 shows a single zipper closure 20 that can be manufactured using conventional extrusion techniques. These techniques include flat strip extrusion using a cast film method of manufacture. With flat strip extrusion, multiple closure profiles can be extruded through a single die and subsequently cut into the individual closure profiles 20. The flat strip extrusion can produce a strip containing about four individual zipper closures 20 from a single die. The zipper closure 20, shown on FIG. 3, can also be produced from a tube extrusion that produces a single zipper closure connected at the first end 5 and the second end 6. Tube extrusion is the preferred method of manufacturing the zipper closure 20 having an external and internal tamper-evident structure 50, 51. The zipper closure shown in FIG. 3 may also be produced with a tube extrusion method followed by severance of the connection located at the second end 6.

The zipper closure 20 is preferably made from polyethylene, polypropylene, or copolymers of polyethylene and polypropylene. Especially preferred materials are low density polyethylene and low density polyethylene/polypropylene mixtures. In preferred arrangements, the sealing flange 26, 28 is from 1 to 10 mil thick and preferably between 4 to 8 mil thick. In preferred arrangements, the distal flange 27, 29 is from 1 to 15 mil thick and preferably between 4 to 10 mil thick.

Sealing Flange

First closure sealing flange 26 has an inner surface 34 and an outer surface 36. A first sealing layer 32 may be disposed on the outer surface 36 of the first closure sealing flange 26. Second closure sealing flange 28 has an inner surface 35 and an outer surface 37. A second sealing layer 33 may be disposed on the outer surface 37 of the second closure sealing flange 28.

The first and second sealing layers 32, 33 bond readily to other materials at temperatures below the melt temperature of the sealing flanges 26, 28. The sealing layers 32, 33 are preferably a mixture of low density polyethylene and ethylene vinyl acetate. This mixture allows the sealant material to seal at lower temperatures than low density polyethylene by providing the sealant material with a melting point ranging preferably from 90° C. to 115° C.

The first and second sealing layers 32, 33 can be directly opposite of each other or can be offset. For instance, the first sealing layer 32 can be located at a point lower on the first sealing flange 26 than the second sealing layer 33 on the second sealing flange 28, or vice versa. The sealing layers 32, 33 may also have widths that are dissimilar. This arrangement may allow for excluding the non-sealing layers described below. Offset sealing layers allow sealing heat to be offset relative to each side and thus, the sealing flanges inner surfaces 34, 35 may not reach a temperature sufficient to bond the inner surfaces 34, 35 together.

A first non-sealing layer 30 may be disposed on the inner surface 34 of the first closure profile sealing flange 26. A second non-sealing layer 31 may be disposed on the inner surface 35 of the second closure profile sealing flange 28.

The first and second non-sealing layers 30, 31 do not bond readily to other materials. The first and second non-sealing layers 30, 31 are composed of a heat resistant (or insulating) material. First and second non-sealing layers 30, 31 ensure that the inner surfaces of the sealing flanges 34, 35 do not bond together during the heat sealing process of attaching the polymeric side panels 12, 14 to the first and second sealing layers 32, 33. The first and second non-sealing layers 30, 31 and the first and second sealing layers 32, 33 can be co-extruded together with the closure profile 20.

Another approach to prevent inner surface 34, 35 bonding is to increase sealing flange 26, 28 thickness. A thicker sealing flange 26, 28 will prevent the inner surface 34, 35 from obtaining a temperature high enough to allow the inner surfaces 34, 35 of the sealing flanges 26, 28 from bonding with each other.

Tamper Evident Structure

Package 10 includes at least one, and in some arrangements, more than one, tamper-evident structures 50, 51 positioned between or joining first and second closure profiles 22, 24. By "tamper-evident", it is meant that it provides an indication to the consumer as to whether package 10 has been previously opened. In order to access the interior 11 of the package 10, the tamper-evident structure 50 needs to be penetrated. In other words, tamper-evident structure 50 acts as a barrier to and blocks access to the package interior 11. Tamper-evident structure 50 is considered an "internal" tamper-evident structure because it is positioned between zipper closure 20 and package interior 11. Tamper-evident structure 51 is considered an "external" tamper-evident structure because it is positioned between zipper closure 20 and package exterior. Tamper-evident structure 51 acts as a barrier and blocks access to the zipper closure 20. The tamper-evident structures shown in FIGS. 3–8 are applicable to both "internal" and "external" tamper-evident structures.

For package 10 in FIG. 2, the particular tamper-evident structure 50 illustrated is a web or membrane member 52 extending between and connecting sealing flanges 26, 28 of first and second closure profiles 22, 24. Preferably, web member 52 is integral with sealing flanges 26, 28; that is, there is no discernible boundary where sealing flanges 26, 28 end and tamper-evident structure 50, specifically web member 52, begins. For embodiments with an external tamper-evident structure 51 or web member 53, the web member 53 and distal flanges 27, 29 may have a discernable boundary where the distal flanges 27, 29 and web member 53 interface.

FIG. 3 shows zipper closure 20, with web member 52, prior to incorporation into package 10. Such a construction as zipper closure 20 of FIGS. 2 and 3 is made by extruding a single structure that includes both closure profiles 22, 24 and tamper-evident structure 50, which is web member 52. To form tamper-evident structure 50, the separate profiles can be joined together, for example, by connecting sealing flanges 26, 28 directly to each other at a seal or seam, or by providing a discrete film or membrane connecting the sealing flanges 26, 28. These various modes of attaching sealing flanges 26, 28 can provide a continuous tamper-evident structure 50 along the length of zipper closure 20, or the tamper-evident structure 50 can be intermittent or segmented along the length of zipper closure 20.

A preferred tamper-evident structure 50, 51 is a web arrangement 52, 53 joining the first closure profile 22 and the second closure profile 24. This web arrangement 52, 53 includes a plurality of tear regions 54 (FIGS. 3–8) radially spaced across the web arrangement 52, 53. By "radially spaced", it is meant that the tear regions 54 are located intermittently along the web arrangement 52, 53, spaced a distance apart from one another and between the first sealing flange 26 and the second sealing flange 28. Each of the tear regions 54 has a lower shear strength than the remaining portions 55 of the web arrangement 52, 53. By "shear strength", it is meant the degree of force applied tangentially on a section on which the action is performed. The action of this force causes, or tends to cause, two contiguous parts of the web arrangement 52, 53 to slide relative to each other in a direction parallel to their plane of contact. The lower shear strength of the tear regions 54 relative to the remaining portions 55 allows for penetration of the web arrangement 52, 53 and provides a visual indication that the integrity of the flexible package has been compromised.

Preferably, the web arrangement 52, 53 contains at least three tear regions 54 and preferably more than three tear regions 54. A plurality of tear regions 54 provides the consumer easy access into the reclosable package 10. The tear regions 54 may include a material different than the material of the remaining portions 55 of the web arrangement 52, 53. The tear regions 54 may include a material similar to, but thinner than, the material of the remaining portions 55 of the web arrangement. Either embodiment provides tear regions 54 with a shear strength less than the shear strength of the remaining portions 55 of the web arrangement 52, 53.

The tear region 54 may include a material different than the remaining portions 55 of the web arrangement 52, 53. The material of the remaining portion 55 can be the same material used to make the first and second closure profiles 22, 24. The tear region 54 material can be co-extruded with the closure profile from either a flat or a tube extrusion die. FIG. 3 illustrates a profile that could be extruded from a flat die. FIG. 2 illustrates a profile that could be extruded from a tube die. One advantage of tube extrusion is that tube extrusion can produce a closure profile 20 that contains a web arrangement 52, 53 both above and below the interlocking closure profile 20 as shown in FIG. 2.

Preferably, the material of the remaining portions 55 of the web arrangement 52, 53 is a polymer selected from the group consisting of low density polyethylene, linear low density polyethylene, ethylene vinyl acetate and mixtures thereof. Preferably, the material of the tear regions 54 is a polymer selected from the group consisting of polypropylene, polybutylene, polyester, nylon, high molecular weight high density polyethylene, high density polyethylene, and mixtures thereof. Preferably nylon is nylon 6, nylon 6—6 and the like. Subsequent to co-extrusion of the closure profile 20 with tear regions. 54 of different material than the material of the remaining portions 55, the application of heat to the tear regions 54 and remaining portions 55 weakens the interfacial bond strength between the tear region 54 material and the remaining portion 55 material. This weakening of the interfacial bond strength further reduces the shear strength of the tear regions 54 relative to the remaining portions 55.

Thus, with a controlled application of heat to the web arrangement 52, 53, the amount of force required to penetrate the tear portions 54 can be accurately regulated. Heat can be applied at any time following co-extrusion of the closure profile 20. Preferably, heat from the operation of sealing the side panels to the sealing layers 32, 33 can be utilized to weaken the tear regions 54. A wide seal bar 60 may be used to fuse the side panels 12, 14 to the seal layer 32, 33 and provide the heat necessary to weaken the tear region 54.

Web Arrangements

Figure 4:
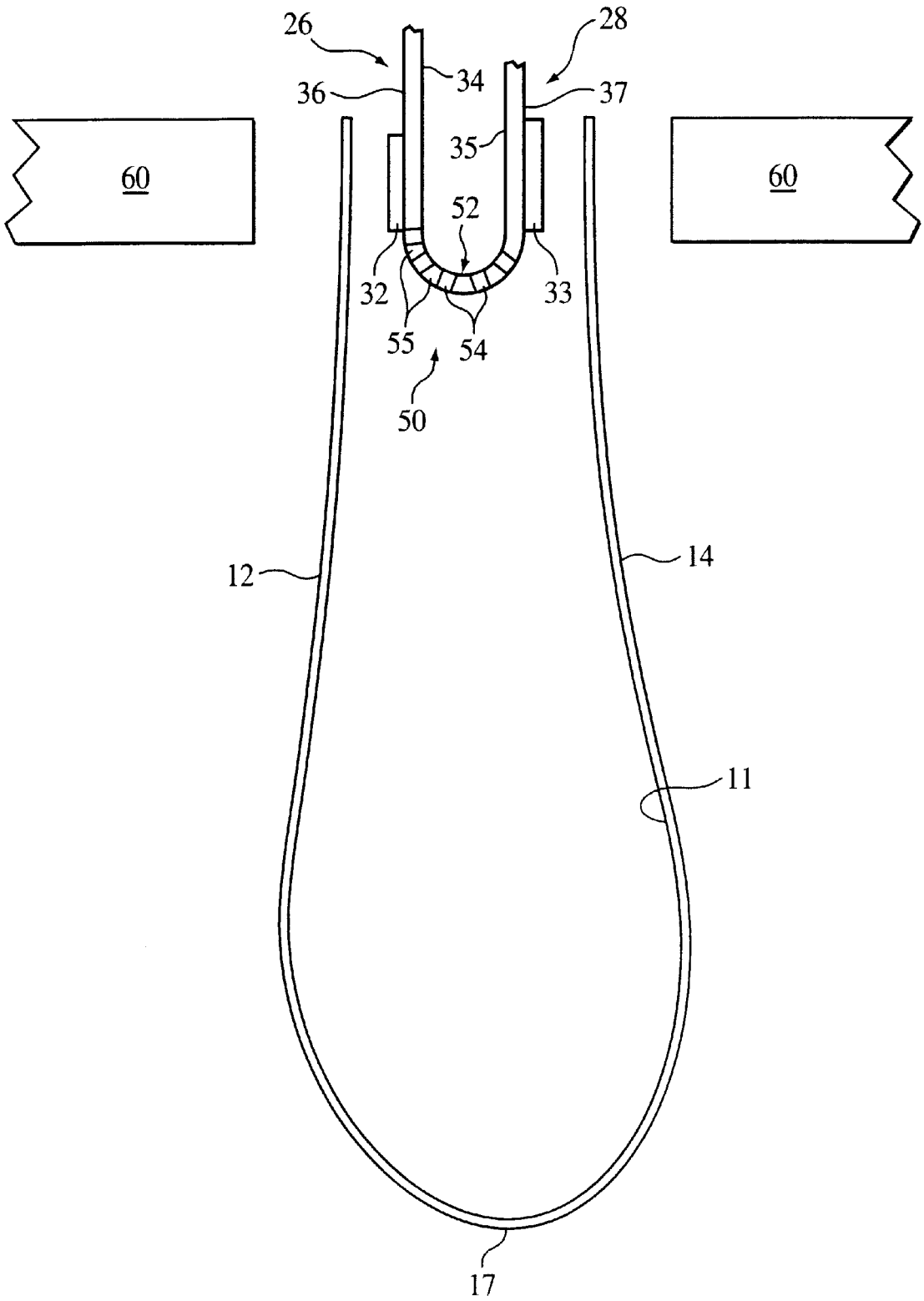
FIG. 4 is a schematic, cross-sectional view of a second embodiment of a flexible, reclosable package, analogous to the view of the package of FIG. 2 with heat seal bars shown.
Figure 5:
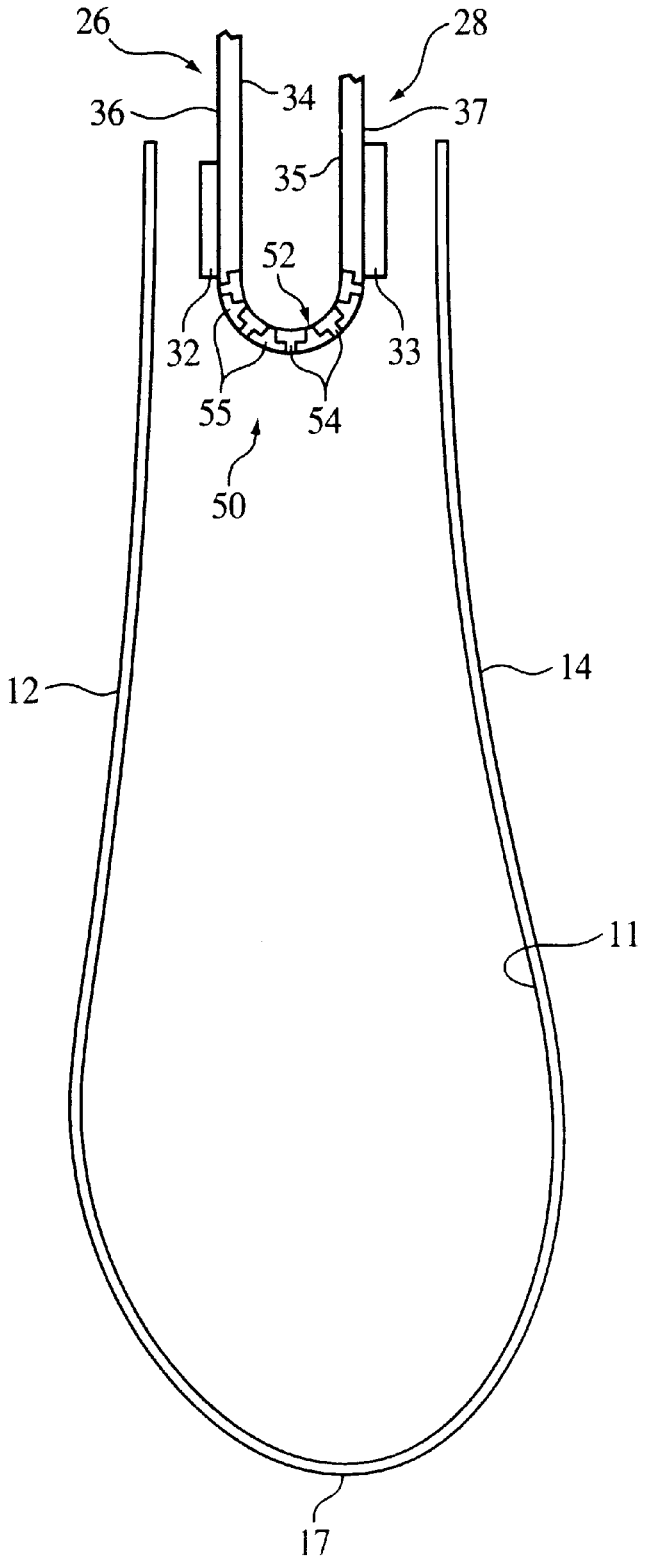
FIG. 5 is a schematic, cross-sectional view of a third embodiment of a flexible, reclosable package, analogous to the view of the package of FIG. 2.
Figure 6:
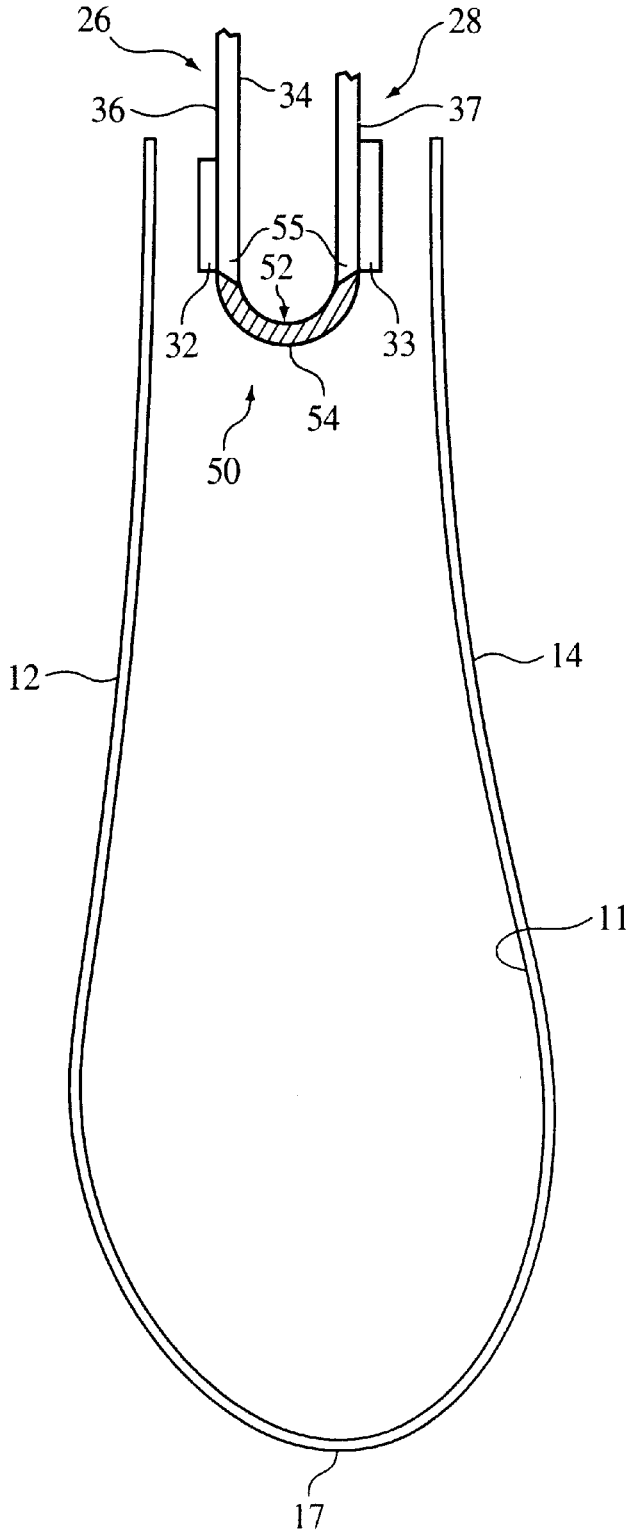
FIG. 6 is a schematic, cross-sectional view of a fourth embodiment of a flexible, reclosable package, analogous to the view of the package of FIG. 2.
Figure 7:
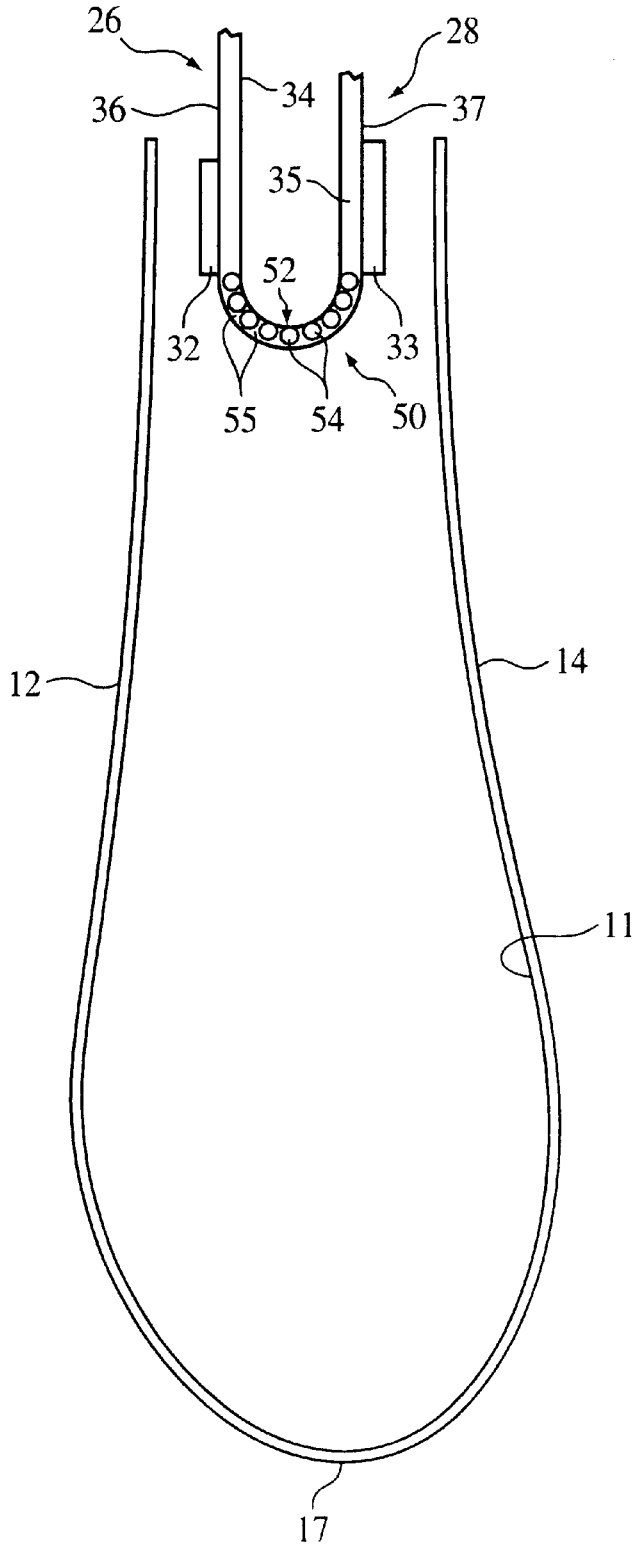
FIG. 7 is a schematic, cross-sectional view of a fifth embodiment of a flexible, reclosable package, analogous to the view of the package of FIG. 2.
Figure 8:
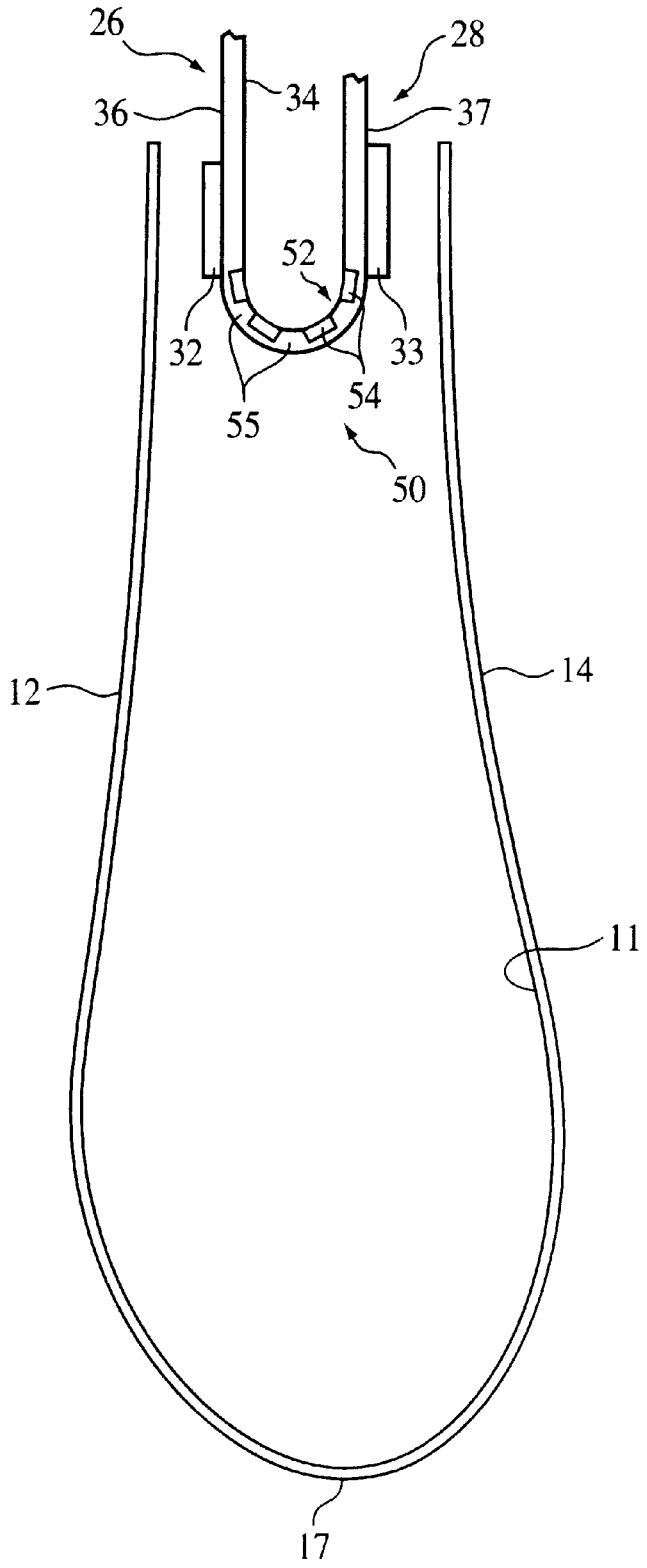
FIG. 8 is a schematic, cross-sectional view of a sixth embodiment of a flexible, reclosable package, analogous to the view of the package of FIG. 2.

The web arrangement 52, 53 can have the tear region 54 and remaining portion 55 co-extruded such that the different materials are disposed in "slices" 65 that span the entire thickness of the web arrangement 52, 53 and are sandwiched between each other as shown in FIG. 4. By "slices", it is meant that discrete tear regions 54 extend through or span the entire thickness of the web arrangement 52, 53 and are interdisposed between one another along the web arrangement 52, 53 from the first sealing flange 26 to the second sealing flange 28. By "span the entire thickness" it is meant that the tear regions 54 have a top and bottom surface contiguous with the remaining portions 55 top and bottom surface. The tear region 54 may be a single layer of a material different than the remaining portion 55, as shown in FIG. 6. Alternatively, the web arrangement 52, 53 can have the tear region 54 and remaining portion 55 co-extruded such that the different materials are disposed on each other in layers that span at least a portion of the width of the web arrangement 52, 53 as shown in FIG. 3.

A web arrangement 52, 53 with a plurality of layers preferably has two layers of different material but may have three or more layers of different material depending on the desired application. One layer may function as a hermetic barrier layer made from a material such as nylon, for example. Optionally, the web arrangement 52, 53 can be coated with a hermetic barrier material such as Saran®. A web arrangement 52, 53 with two layers of different material preferably is co-extruded so the interface between the two layers defines geometric shapes, thus creating the tear regions 54. The geometric shapes may include a variety of shapes. Of those possible, the FIGS. illustrate a T shape 70 (see FIG. 5), a trapezoid shape 52 (see FIG. 3), a triangle shape 54 (see FIG. 3), a round shape 75 (see FIG. 7) and a rectangle shape 80 (see FIG. 8).

Embodiments where portions of the tear regions 54 have a thickness less than the remaining portions 55 of the web arrangement 52, 53 are also contemplated. These embodiments have a thickness ratio of tear regions 54 to remaining portions 55 of about 1:1.5 to 1:10 and preferably about 1:2 to 1:5. The thickness of the tear regions 54 can be about 0.5 to 2 mil thick. The thickness of the remaining portions 55 can be about 4 to 10 mil thick. External tamper-evident structures 51 may have a single tear region 54 where portions of the tear region 54 have a thickness less than the remaining portions 55.

Referring again to FIG. 1, there is an optional slider device 40 mounted on zipper closure 20 to facilitate opening and closing zipper closure 20. Slider devices and how they function to open and close zipper closures, in general, are taught, for example, in U.S. Pat. Nos. 5,063,644; 5,301,394; and 5,442,837, each of which is incorporated by reference herein. A preferred slider device is taught in U.S. patent application Ser. Nos. 09/365,215 and 29/108,657, both filed Jul. 30, 1999, and incorporated herein by reference in their entirety. A notch 42 is disposed within zipper closure 20 adjacent to a second edge 15 in package 10. Notch 42 is designed to provide a "park place" into which slider device 40 settles when zipper closure 20 is sealed and slider device 40 is at second edge 15. Such a notch 42 may decrease any tendency for an incomplete interlock between first closure profile 22 and second closure profile 24.

Methods of Use

In order to open the reclosable flexible package 10, the consumer grips the first closure profile 22 and the second closure profile 24 and pulls the first closure profile 22 and the second closure profile 24 apart such that the closure profiles 22, 24 disengage from one another and expose web arrangement 52. The web arrangement 52 blocks access to the package interior 11. Next, the consumer penetrates the web arrangement 52 through at least one tear region 54 of the web arrangement 52. The flexible package 10 can be resealed utilizing the reclosable zipper closure 20. Specifically, the consumer grips first and second closure profiles 22, 24 and moves it from the open position to the closed position so as to engage the complimentary closure profiles 22, 24. Optionally, a slider device 40 mounted on zipper closure 20 facilitates the engagement and disengagement of the complimentary closure profiles 22, 24 as the slider device 40 moves from a first position to a second position along the zipper closure 20.

In an alternate embodiment depicted in FIG. 1, the first and second closure profiles 22, 24 may include a second web arrangement 53. In this embodiment, the consumer penetrates the second web arrangement 53 prior to or during the action of disengaging the first and second closure profiles 22, 24. Optionally, a slider device 40 mounted on zipper closure 20 facilitates the penetration of the second web member 53 as the slider device 40 moves from a first position to a second position along the zipper closure 20. After the second web arrangement 53 is broken, the first and second closure profiles 22, 24 are disengaged, and the first web arrangement 52 is exposed and broken, as described above.

The above specification is believed to provide a complete description of the manufacture and use of particular embodiments of the invention. Many embodiments of the invention can be made without departing from the spirit and scope of the invention.

What is claimed:

1. A method of making a flexible package comprising:

(a) providing a package surrounding wall defining a package interior and having a mouth; the mouth providing access to the package interior;

(b) providing a reclosable zipper for selective opening and closing of the mouth; the zipper including:

(i) a first closure profile, the first closure profile having a sealing flange located at a first end of the first closure profile and a distal flange located at a second end of the first closure profile;

(ii) a second closure profile, the second closure profile having a sealing flange located at a first end of the second closure profile and a distal flange located at a second end of the second closure profile;

(iii) a web arrangement joining the first closure profile sealing flange and the second closure profile sealing flange; the web arrangement including a plurality of tear regions radially spaced across the web arrangement; each of the tear regions having a first shear strength and being a material different than the remaining portions of the web arrangement;

(iv) a slider device operably mounted onto the reclosable zipper, the slider device constructed and arranged for interlocking the first closure profile with the second closure profile when the slider device is moved in a first direction, and for disengaging the first closure profile from the second closure profile when the slider device is moved in a second opposite direction;

(c) joining the first closure profile sealing flange and the second closure profile sealing flange to the package surrounding wall at the mouth, and maintaining a portion of the web arrangement unsealed to the surrounding wall; and (d) heating at least a part of the portion of the web arrangement unsealed to the surrounding wall to reduce the first shear strength of the tear regions to a lower second shear strength.

2. A method of making a flexible package according to claim 1, wherein the step of providing a reclosable zipper comprises:

(a) providing a reclosable zipper wherein the material of the remaining portions of the web arrangement is a polymer selected from the group consisting of low density polyethylene, linear low density polyethylene, ethylene vinyl acetate, and mixtures thereof.

3. A method of making a flexible package according to claim 1, wherein the step of providing a reclosable zipper comprises:

(a) providing a reclosable zipper wherein the material of the tear regions is a polymer selected from the group consisting of polypropylene, polybutylene, polyester, nylon, high molecular weight high density polyethylene, high density polyethylene, and mixtures thereof.

4. A method of making a flexible package according to claim 1, wherein the step of heating at least a part of the portion of the web arrangement unsealed to the surrounding wall occurs simultaneously with the step of joining the reclosable zipper to the mouth.

5. A method of making a flexible package according to claim 1, wherein the step of providing a reclosable zipper comprises:

(a) providing a reclosable zipper wherein the web arrangement includes at least three tear regions radially spaced across the web arrangement.

6. A method of making a flexible package comprising:

(a) providing a package surrounding wall defining a package interior and having a mouth; the mouth providing access to the package interior;

(b) providing a reclosable zipper for selective opening and closing of the mouth; the zipper including:

(i) a first closure profile, the first closure profile having a sealing flange located at a first end of the first closure profile and a distal flange located at a second end of the first closure profile;

(ii) a second closure profile, the second closure profile having a sealing flange located at a first end of the second closure profile and a distal flange located at a second end of the second closure profile;

(iii) a web arrangement joining the first closure profile distal flange and the second closure profile distal flange; the web arrangement including a plurality of tear regions radially spaced across the web arrangement; each of the tear regions having a first shear strength and being a material different than the remaining portions of the web arrangement;

(iv) a slider device operably mounted onto the reclosable zipper, the slider device constructed and arranged for interlocking the first closure profile with the second closure profile when the slider device is moved in a first direction, and for disengaging the first closure profile from the second closure profile when the slider device is moved in a second opposite direction;

(c) joining the first closure profile scaling flange and the second closure profile sealing flange to the packaging surrounding wall at the mouth, and maintaining a portion of the web arrangement unsealed to the surrounding wall; and (d) heating at least a part of the position of the web arrangement unsealed to the surrounding wall to reduce the first shear strength of the tear regions to a lower second shear strength.

7. A method of making a flexible package according to claim 6, wherein the step of providing a reclosable zipper comprises:

(a) providing a reclosable zipper wherein the material of the remaining portions of the web arrangement is a polymer selected from the group consisting of low density polyethylene, linear low density polyethylene, ethylene vinyl acetate, and mixtures thereof.

8. A method of making a flexible package according to claim 6, wherein the step of providing a reclosable zipper comprises:

(a) providing a reclosable zipper wherein the material of the tear regions is a polymer selected from the group consisting of polypropylene, polybutylene, polyester, nylon, high molecular weight high density polyethylene, high density polyethylene, and mixtures thereof.

9. A method of making a flexible package according to claim 6, wherein the step of heating at least a part of the portion of the web arrangement unsealed to the surrounding wall occurs simultaneously as the step of joining the reclosable zipper to the mouth.

10. A method of making a flexible package according to claim 6, wherein the step of providing a reclosable zipper comprises:

(a) providing a reclosable zipper wherein the web arrangement includes at least three tear regions radially spaced across the web arrangement.

11. A method of making a flexible package according to claim 6, wherein the step of providing a reclosable zipper comprises:

(a) providing a reclosable zipper further comprising a second web arrangement joining the first closure profile sealing flange and the second closure profile sealing flange; the second web arrangement including a plurality of tear regions radially spaced across the second web arrangement; each of the tear regions having a third shear strength and being a material different than the remaining portions of the second web arrangement.

* * * * *

UNITED STATES PATENT AND TRADEMARK OFFICE

CERTIFICATE OF CORRECTION

PATENT NO. : 6,605,026 B1
DATED : August 12, 2003
INVENTOR(S) : Mladomir Tomic

It is certified that error appears in the above-identified patent and that said Letters Patent is hereby corrected as shown below:

Column 9,
Line 1, insert -- sealing -- delete “scaling”.

Signed and Sealed this

Twenty-second Day of November, 2005

JON W. DUDAS
*Director of the United States Patent and Trademark Office*